US012765671B2

(12) United States Patent
Sutterluetti

(10) Patent No.: US 12,765,671 B2
(45) Date of Patent: Oct. 20, 2026

(54) DRAWER PULL-OUT GUIDE

(71) Applicant: Julius Blum GmbH, Hoechst (AT)

(72) Inventor: Harald Sutterluetti, Fussach (AT)

(73) Assignee: JULIUS BLUM GMBH, Hoechst (AT)

( * ) Notice: Subject to any disclaimer, the term of this patent is extended or adjusted under 35 U.S.C. 154(b) by 82 days.

(21) Appl. No.: 18/418,959

(22) Filed: Jan. 22, 2024

(65) Prior Publication Data

US 2024/0164521 A1 May 23, 2024

Related U.S. Application Data

(63) Continuation of application No. PCT/AT2022/060254, filed on Jul. 15, 2022.

(30) Foreign Application Priority Data

Jul. 23, 2021 (AT) ..... A 50614/2021

(51) Int. Cl.
*A47B 88/919* (2017.01)
*A47B 88/423* (2017.01)

(52) U.S. Cl.
CPC ..... *A47B 88/919* (2017.01); *A47B 88/423* (2017.01)

(58) Field of Classification Search
CPC ..... A47B 88/483; A47B 88/43; A47B 88/49; A47B 88/477; A47B 2210/0021; A47B 2210/0035; A47B 2210/0056
See application file for complete search history.

(56) References Cited

U.S. PATENT DOCUMENTS

| | | | | |
|---|---|---|---|---|
| 6,644,609 | B1 | 11/2003 | Scott | |
| 7,562,950 | B2 | 7/2009 | Lam et al. | |
| 8,678,529 | B2 | 3/2014 | Li | |
| 2006/0091770 | A1* | 5/2006 | Ritter | A47B 88/493 312/334.13 |
| 2006/0214548 | A1 | 9/2006 | Lam et al. | |
| 2011/0188788 | A1 | 8/2011 | Li | |

(Continued)

FOREIGN PATENT DOCUMENTS

| | | |
|---|---|---|
| CN | 202681157 | 1/2013 |
| CN | 103519585 | 7/2015 |

(Continued)

OTHER PUBLICATIONS

International Search Report issued Oct. 20, 2022 in International (PCT) Application No. PCT/AT2022/060254.

(Continued)

*Primary Examiner* — Cassandra Davis
(74) *Attorney, Agent, or Firm* — Wenderoth, Lind & Ponack, L.L.P.

(57) ABSTRACT

A drawer pull-out guide for movably supporting a drawer on a furniture body includes a body rail to be secured to the furniture body, a loading rail to be connected to the drawer and movably mounted relative to the body rail in a longitudinal direction, and—optionally—a central rail arranged between the body rail and the loading rail. The drawer pull-out guide has a dead weight and a maximum load-bearing capacity, and the ratio of the dead weight of the drawer pull-out guide to the maximum load-bearing capacity of the drawer pull-out guide is less than 1 to 50, preferably less than 1 to 57, particularly preferably less than 1 to 65.

25 Claims, 7 Drawing Sheets

(56) References Cited

U.S. PATENT DOCUMENTS

| | | | |
|---|---|---|---|
| 2015/0002008 | A1 | 1/2015 | Domenig et al. |
| 2015/0230604 | A1 | 8/2015 | Violand et al. |

FOREIGN PATENT DOCUMENTS

| | | | | |
|---|---|---|---|---|
| CN | 204483536 | | 7/2015 | |
| CN | 208972975 | | 6/2019 | |
| DE | 24 27 811 | | 1/1976 | |
| DE | 89 11 357 | | 1/1990 | |
| DE | 20 2009 003 459 | | 8/2010 | |
| DE | 10 2010 036 431 | | 1/2012 | |
| DE | 10 2013 010 577 | | 12/2014 | |
| DE | 10 2013 111 076 | | 4/2015 | |
| DE | 102016125028 | A1 * | 6/2017 | ..... A47B 88/40 |
| DE | 10 2019 111 292 | | 11/2020 | |
| DE | 10 2019 111 655 | | 11/2020 | |
| EP | 2 168 454 | | 3/2010 | |
| EP | 2 241 218 | | 10/2010 | |
| EP | 2241218 | A1 * | 10/2010 | ..... A47B 88/487 |
| EP | 2 429 340 | | 8/2013 | |
| EP | 2215928 | B1 * | 5/2016 | ..... A47B 88/487 |
| JP | 60-8655 | | 1/1985 | |
| JP | 2010-220901 | | 10/2010 | |
| JP | 3196235 | U * | 2/2015 | |
| JP | 2016-501046 | | 1/2016 | |
| WO | 2004/103119 | | 12/2004 | |

OTHER PUBLICATIONS

"Xuuyu Drawer Slide Rail, Maximum Load: 15-20 kg, Telescopic, 342 mm, Two-Stage, 17 mm Thick, High-Hardness, Cold-Rolled Steel Sheet Material; Drawer, Cabinet, Laboratory Drawer, Decorative Cabinet," online, Amazon, Jul. 28, 2020, URL: https://x.gd/oDpaE, Accessed Mar. 13, 2025.

* cited by examiner

DRAWER PULL-OUT GUIDE

The present application is a continuation of International Application PCT/AT2022/060254, filed Jul. 15, 2022. Thus, all of the subject matter of International Application PCT/AT2022/060254 is incorporated herein by reference.

BACKGROUND OF THE INVENTION

The present invention relates to a drawer pull-out guide for movably mounting a drawer on a furniture carcass, comprising:

- a carcass rail to be fastened to the furniture carcass,
- at least one drawer rail to be connected to the drawer, which drawer rail is mounted displaceable relative to the carcass rail in a longitudinal direction,
- possibly at least one center rail, which is arranged between the carcass rail and the at least one drawer rail,
- wherein the drawer pull-out guide has a dead weight and a maximum load-bearing capacity.

The rails of a drawer pull-out guide are often produced from a flat metal sheet, which is processed to form a profile rail by subsequent bending and/or reshaping. The loads on the drawer pull-out guide in the horizontal and in the vertical direction are absorbed by the finished profiles, as a result of which the drawer connected to the drawer pull-out guide can be guided stably.

The requirement for metal, which is normally necessary for the production of a drawer pull-out guide, represents a general problem. High material usage leads to a high weight and to increased costs in series manufacturing. It is therefore desirable to use as little metal as possible, especially as a resource-conserving use of raw materials brings with it both ecological and economic advantages.

SUMMARY OF THE INVENTION

The object of the present invention is to specify a drawer pull-out guide of the type mentioned at the beginning in which the named problems of the state of the art are at least partially avoided.

According to the invention, the ratio of the dead weight of the drawer pull-out guide to the maximum load-bearing capacity of the drawer pull-out guide is less than 1 to 50, preferably less than 1 to 57, particularly preferably less than 1 to 65.

Until now, a person skilled in the art in the field of the furniture fittings industry has assumed that a particular material usage is required to implement a drawer pull-out guide which has a particular stability with a predefined maximum load-bearing capacity.

Conventional drawer pull-out guides from the applicant have, for example, a ratio of the dead weight of the drawer pull-out guide to the maximum load-bearing capacity of the drawer pull-out guide of 1 to 40 or above. Lower ratios did not appear to be implementable.

Within the framework of the invention, the applicant's experts have surprisingly found, contrary to this expectation, that it is possible to advance into an entirely different regime during the construction of drawer pull-out guides.

In this way, the material usage can be significantly reduced, e.g. halved, which is accompanied by a substantial reduction of the manufacturing costs and at the same time by a substantial resource efficiency, in particular in view of the large quantities prevalent in the furniture fittings industry.

It may be pointed out that the technical testing and assessment of drawer pull-out guides is standardized at least in the European region. In this connection, reference may be made to the standard DIN EN 15338, in which the strength and durability of extension elements and their components are defined. However, this standard makes no statements regarding the ratio of the dead weight to the maximum load-bearing capacity of a drawer pull-out guide.

The maximum load-bearing capacity is not an arbitrary variable, but is fixed for a person skilled in the art. The maximum load-bearing capacity is normally also recorded on the drawer pull-out guide, e.g. by stamps.

Advantageously, the at least one drawer rail is displaceable relative to the carcass rail over a pull-out length between a pushed-in end position and a pulled-out end position. The at least one drawer rail has a front end to be connected to a front panel of the drawer, and in the pulled-out end position the front end of the at least one drawer rail can drop by a maximum of 4% of the pull-out length in the case of a load which corresponds to the maximum load-bearing capacity.

The invention is suitable in a particularly advantageous manner for a drawer pull-out guide which has a length of between 200 mm and 650 mm in a completely pushed-in state, and/or has a dead weight of between 125 g and 550 g, and/or has a maximum load-bearing capacity of between 15 kg and 35 kg, and/or is manufactured at least predominantly from steel. According to a specific embodiment it can be provided that the drawer pull-out guide has a maximum load-bearing capacity of 25 kg, a length of 500 mm and a dead weight of approx. 350 g.

Alternatively or additionally, at least one rolling body is arranged between the carcass rail and the at least one drawer rail. Preferably, the at least one rolling body is mounted rotatable about an axis of rotation, and particularly preferably the axis of rotation is aligned transverse to the longitudinal direction, and/or at least one carriage, in particular made of plastic, is provided, in which the at least one rolling body is arranged, and/or the at least one rolling body is formed substantially cylindrical, and/or the at least one rolling body consists at least predominantly of plastic. Such a drawer pull-out rail differs, in terms of its design, significantly from other drawer pull-out rails, such as e.g. heavy-duty pull-outs or ball guides.

It has proved to be favorable that the drawer pull-out guide is formed at least in portions from a flat metal sheet, which has a material thickness of between 0.5 mm and 1.0 mm, preferably a material thickness of 0.7 mm. A much thinner metal sheet is thus used than in the case of a conventional drawer pull-out guide with a comparative design.

In a particularly advantageous manner, the ratio, which is low compared with the state of the art, of the dead weight of the drawer pull-out guide to the maximum load-bearing capacity of the drawer pull-out guide can be implemented in that the drawer pull-out guide has at least one property, preferably more than one, selected from the following group of properties i. to v.:

- Property i.: At least one of the rails has, in a cross section normal to the longitudinal direction, at least one profile formed from at least one flat metal sheet with two longitudinal edges running parallel to each other. The profile has at least one foldover with at least a double material thickness on at least one longitudinal edge, preferably on both longitudinal edges.
- Property ii.: The carcass rail has at least one fastening portion with a fastening side which, during installation of the drawer pull-out guide on the furniture carcass, can be attached to the furniture carcass at least in portions. The at least one fastening portion has at least one, preferably circular, opening for a fastening means, preferably a screw, to pass through. The at least one opening, on a second side spaced apart from the fastening side by a material thickness of the fastening portion, is surrounded by a ridge which protrudes transversely from the second side of the fastening portion.

Property iii.: At least one of the rails has, in a cross section normal to the longitudinal direction, a profile formed from at least one flat metal sheet. At least one end surface of the profile, in particular two, is formed with a taper.

Property iv.: At least one of the rails has, in a cross section normal to the longitudinal direction, at least one profile formed from at least one flat metal sheet with two longitudinal edges running parallel to each other. At least one embossing extending at least in areas over at least two lateral surfaces of the profile arranged substantially orthogonal to each other is arranged for reinforcing the profile, and the lateral surfaces are arranged in the longitudinal direction and the at least one embossing is arranged substantially orthogonal to the longitudinal direction.

Property v.: At least one of the rails has, in a cross section normal to the longitudinal direction, at least one profile formed from at least one flat metal sheet with two longitudinal edges running parallel to each other. At least two embossings are provided, which are preferably arranged on at least two lateral surfaces oriented substantially orthogonal to and/or adjoining each other and/or extend over at least two lateral surfaces at least in areas. The at least two embossings face in the direction of an inner area and in the direction of an outer area of the at least one rail in an alternating manner, in particular wherein the at least two embossings adjoin each other in the longitudinal direction.

Property i. is associated with the following technical advantages:—

Firstly a simple process of bending the metal sheet is possible, secondly the stiffness of the profile can be increased in the area of the foldover, a rounded edge, which reduces the risk of injury by an otherwise sharp longitudinal edge, is formed due to the foldover, thinner metal sheets than usual can be used for the production of the drawer pull-out guide (thus for example metal sheets with a thickness of 0.7 mm instead of metal sheets with a thickness of 1.5 mm), the stiffness of the highly loaded areas of the carcass rail and/or of the drawer rail and/or of the center rail can be increased due to the at least one foldover. The highly loaded areas include in particular the tracks of the carcass rail and/or of the drawer rail and/or of the center rail, on which rolling bodies (in particular rolling bodies of a carriage) can roll, on the assumption by way of example that a thinner metal sheet with a thickness of 0.7 mm is used, the highly loaded areas thus gain a thickness of 1.4 mm due to the foldover. The rolling bodies can be optimally guided along the rails due to the hardwearing tracks. The remaining areas of the rails, which are not exposed to large loads, on the other hand, can be made with a single, reduced material thickness (thus with a thickness of 0.7 mm). Through these measures the material usage, the weight and the costs for the production of the drawer pull-out guide can be greatly reduced.

In connection with property i., it has proved to be advantageous that the at least one foldover is arranged on at least one longitudinal edge of the carcass rail. The foldover can be attached during fastening of the carcass rail to the furniture carcass, and/or has at least two metal sheet portions resting against each other at least in areas on the at least one longitudinal edge. Preferably, the at least two metal sheet portions have at least one common punching, and/or has at least one crack running in the longitudinal direction on the at least one longitudinal edge in a cross section normal to the longitudinal direction, and preferably the at least one foldover is formed on at least one longitudinal edge of the carcass rail.

Alternatively or additionally, the drawer pull-out guide has at least one rolling body, which is mobile at least in portions in the longitudinal direction along the at least one foldover.

Furthermore, in connection with property i., it can be advantageous that the at least one drawer rail has at least one foldover with at least a double material thickness on both longitudinal edges. The two foldovers are aligned transverse, preferably substantially at right angles, to each other and/or one of the two foldovers is turned inwards and the other of the two foldovers is turned outwards.

Property ii. is associated with the following technical advantages:

the opening, on the side of the fastening portion facing a screwhead, is surrounded by a, preferably annular, ridge, which is provided for receiving the screwhead at least in areas. The screwhead is therefore at least partially, preferably substantially completely, countersinkable inside the ridge, the peripheral rim of the opening is strengthened by the ridge, i.e. the force emanating from the underside of the screwhead can be distributed over a larger surface area. The extent to which the screwhead sinks into the thin-walled metal of the fastening portion can be minimized by the ridge. The risk of damage to the peripheral rim of the opening can therefore be reduced in this way, if the ridge is for example produced in the form of an embossing, then a corresponding recess is formed on the fastening side of the fastening portion, in which recess the chip material coming out of the furniture part can be at least partially received. As a result, the risk of the chip material getting in between the fastening side of the fastening portion and the furniture part and thus leading to an undesired spacing of the fastening portion from the furniture part is also reduced.

In connection with property ii., it has proved to be advantageous that the ridge is formed substantially toroidal in a cross section, and/or is formed in one piece together with the at least one fastening portion, and/or is produced in the at least one fastening portion by embossing.

Property iii. is associated with the following technical advantages:

the taper can be generated without cutting separation processes with a resultant cut width—for example by mechanical breaking, cracking and/or splitting—as a result of which material in the form of separating scrap can be reduced and/or a degree of deformation in the course of a cutting-to-length process for producing the drawer pull-out guide can be reduced, a risk of injury, in particular because of burrs, is reduced for a user of the drawer pull-out guide and/or an installer in installation or during maintenance work on the drawer pull-out guide, wherein cutting postprocessing steps are not compulsory.

In connection with property iii., it has proved to be advantageous that the taper includes an angle in the range between 60° and 140°, preferably between 75° and 105°, particularly preferably of substantially 90°. Preferably, at least one end surface, preferably both, is formed substantially burr-free, and/or has a taper cross section, parallel to the longitudinal extent of the metal sheet, substantially in the shape of a, preferably isosceles, triangle, and preferably the taper cross section is formed convex and/or concave.

For example, identical or different depths and/or geometries can be used for at least one indentation in the metal sheet, which manifests as a taper in the drawer pull-out guide. A geometry of the taper can be adjusted flexibly via a geometry of the indentation. The taper can act as a defined predetermined breaking point for tearing and/or breaking off.

Properties iv. and v. are associated with the following technical advantages:

- the drawer pull-out guide is reinforced beyond a local increase in strength/stability, wherein section moduli and/or moments of inertia are in particular increased and/or vibrations as well as deformations generated by pressure, tension, torsion, bending et cetera are reduced,
- the positioning of the at least one embossing in the longitudinal direction can be flexibly adapted to the demands on the drawer pull-out guide, with the result that areas of the drawer pull-out guide with particularly high loads are also equipped with a particularly high stability and strength due to the structural design via the at least one embossing,
- a degree of possible weight reduction of the drawer pull-out guide is higher than a degree of weight category reduction associated with the weight reduction (or weight reduction) of furniture parts to be moved by the drawer pull-out guide which interact mechanically with the drawer pull-out guide, wherein, in the case of a given weight category (or weight) of furniture parts to be moved by the drawer pull-out guide, a material saving due to a reduction of the wall thickness of the metal sheet can be utilized for forming the drawer pull-out guide and/or furniture parts which are heavier compared with conventional drawer pull-out guides can be moved—in particular while keeping the same lifetime with proper use,
- a force distribution, in particular during a bending process for forming the drawer pull-out guide and/or during use of the rail, can be influenced particularly favorably in regions of the drawer pull-out guide with high stress, wherein a geometric fidelity of the drawer pull-out guide can in particular be guaranteed to a particularly high degree,
- in the case of an alternating arrangement of embossings (relative to adjoining lateral surfaces and/or relative to the inner area/outer area), the process of bending a flat metal sheet to form a profile shape of the drawer pull-out guide can be promoted, in order to be able to manufacture a profile with particularly high geometric precision, which can be maintained for the duration of use of the drawer pull-out guide,
- a gaping transverse to the longitudinal direction of the drawer pull-out guide, wherein an angle between lateral surfaces of the profile increases in an undesired manner under load, and/or a deformation detrimental to the functionality of the drawer pull-out guide, in particular in the longitudinal direction, is effectively counteracted, wherein no additional component parts are necessary in order to implement the technical effects.

The embossing can also be called a lock beading or reinforcing bead in the sense of a plastic deformation as work hardening, which is forced into a metal sheet or a profile, in order to generate an increase in stability or strength—in particular by increasing section moduli and/or moments of inertia and/or reducing vibrations as well as deformations generated by pressure, tension, torsion, bending et cetera.

In connection with properties iv. and v., it has proved to be advantageous that at least one carriage with at least one rolling body and/or sliding body is arranged or arrangeable on the drawer pull-out guide. The at least one embossing is arranged on the at least one carcass rail and/or the at least one drawer rail in such a way that the at least one embossing is traversable contactlessly in the longitudinal direction by the at least one carriage and/or the at least one rolling body and/or sliding body.

A user-friendly guiding of the drawer pull-out guide can thereby be guaranteed, wherein the movement of the at least one carriage is not impaired by the at least one embossing.

Alternatively or additionally, precisely three embossings for reinforcing the profile are arranged at least in areas on at least two substantially orthogonally arranged lateral surfaces of the at least one rail.

In the state of the art, small material thicknesses are associated with significant performance losses and/or lifetime losses during operation of the rail. Through three alternating relative to adjoining lateral surfaces and/or relative to an inner area and an outer area of the at least one rail—in particular drawer rail, carcass rail and/or center rail—small material thicknesses can also be used in the case of rails with high load requirements or heavy movable furniture parts.

It has proved to be particularly favorable that the at least two embossings are arranged on the same lateral surface or on the same lateral surfaces extending over at least two lateral surfaces and/or on the at least two lateral surfaces in an alternating manner. Preferably, the at least two embossings are arranged in a transition area of the at least two lateral surfaces in an alternating manner relative to the inner area and the outer area.

For example, embossings which are aligned in the inner area and outer area in an alternating manner can be arranged on one lateral surface. Alternatively or additionally, one of the embossings can extend across two lateral surfaces and/or an alternating arrangement of the embossings relative to the lateral surfaces can be provided, and two embossings arranged next to each other are oriented substantially orthogonal to each other.

According to an embodiment, at least, preferably in the case of possibly present groups precisely, two embossings face in the direction of the inner area of the at least one rail and one embossing is arranged in the middle between the at least two embossings and faces in the direction of the outer area of the at least one rail to increase a tensile/compressive strength.

A tensile/compressive strength of the rail is gradually increased by an increasing number of embossings. A rail withstands particularly large forces without plastic and/or improper elastic deformation due to alternating embossings and in particular due to an embossing oriented in the opposite direction (inner or outer area) in the middle between two embossings. In addition, the at least one embossing can serve as a support during installation of the drawer pull-out guide.

And finally, in connection with properties iv. and v., it is appropriate that the at least one embossing extends in the orthogonal direction relative to the longitudinal direction of the at least one rail over an area of between one third and three quarters of the lateral surface and/or extends over an area of less than one third, preferably one quarter, of a lateral surface adjoining this lateral surface.

The at least one embossing can generally extend in the direction orthogonal to the longitudinal direction across an entire lateral surface. Such a structural design is generally not necessary due to lower loads on free longitudinal edges. In particular, in the case of an alternating arrangement of embossings with respect to the lateral surfaces, an extent of the individual embossings with respect to a lateral surface can be reduced as both lateral surfaces are strengthened by embossings. This can enhance an esthetic appearance and/or reduce manufacturing effort. The at least one embossing can end in a transition area of the lateral surfaces or extend across it.

BRIEF DESCRIPTION OF THE DRAWINGS

Further details and advantages of the present invention arise from the following description of the figures, in which.

DETAILED DESCRIPTION OF THE INVENTION

Figure 1A:
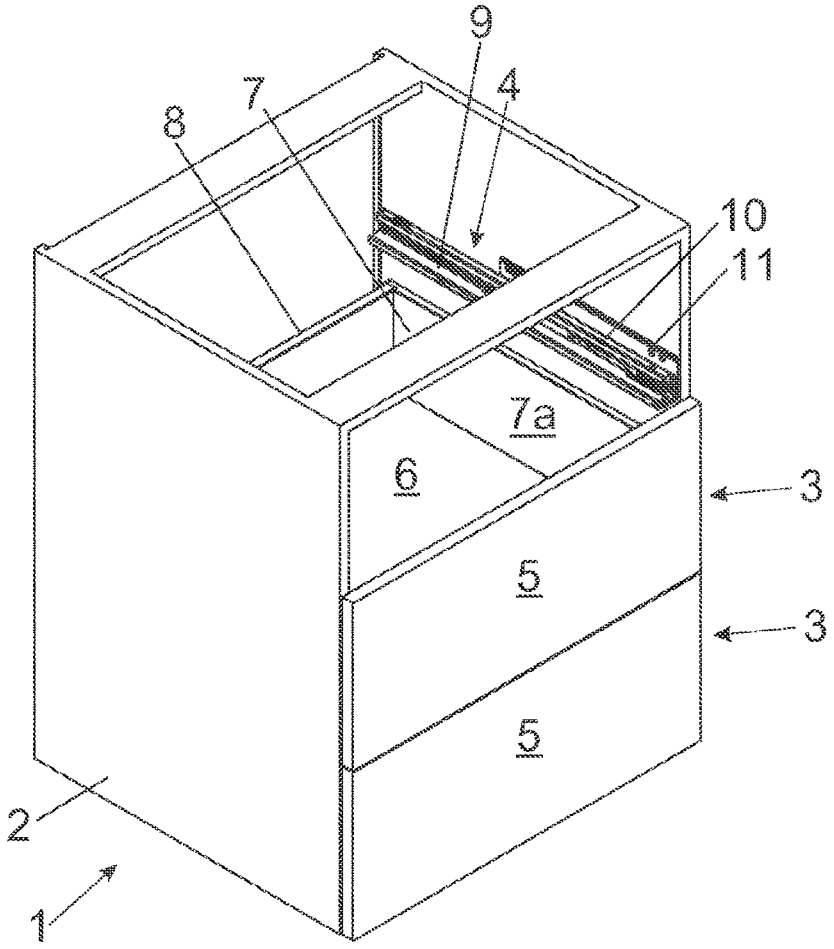
FIG. 1*a* shows a piece of furniture with drawers in a perspective view.

FIG. 1*a* shows a perspective view of a piece of furniture 1 with a furniture carcass 2, wherein drawers 3 are mounted mobile relative to the furniture carcass 2 via drawer pull-out guides 4. For the sake of the improved view, the top drawer 3 is not represented. The drawers 3 in each case have a front panel 5, a drawer bottom 6, drawer side walls 7 and a back wall 8.

The drawer pull-out guides 4 comprise a carcass rail 9, which is to be fastened to the furniture carcass 2 via a fastening portion 11. Furthermore, at least one drawer rail 10 is provided, which is to be connected to the drawer 3 and which is mounted mobile relative to the stationary carcass rail 9.

The drawer pull-out guide 4 can possibly also have a center rail 40 (see FIG. 3*a*), which is mobile between the carcass rail 9 and the drawer rail 10 and through which it is possible to pull the drawer 3 out completely in relation to the furniture carcass 2.

The drawer side walls 7 can in each case have a hollow-chamber profile 7*a*, which is connected or connectable to the at least one drawer rail 10 of the drawer pull-out guide 4.

Figure 1B:
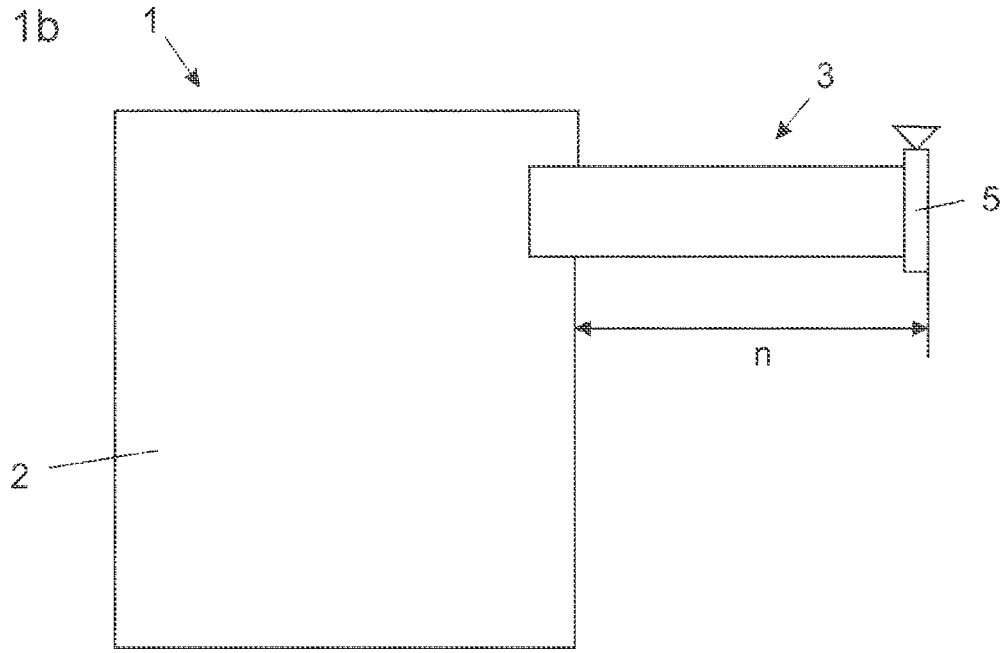
FIG. 1*b* shows a piece of furniture with a pulled-out drawer in a side view.

FIG. 1*b* shows a piece of furniture 1 with a pulled-out drawer 3 in a side view. The at least one drawer rail 10 of the drawer pull-out guides 4, on which the drawer 3 is mounted, is displaceable relative to the carcass rail 9 over a pull-out length (n) between a pushed-in end position and a pulled-out end position.

The at least one drawer rail 10 has a front end connected to the front panel 5 of the drawer 3 and in the pulled-out end position the front end of the at least one drawer rail 10 can drop by a maximum of 4% of the pull-out length (n) in the case of a load which corresponds to the maximum load-bearing capacity. The drop of the front end is indicated with an arrow.

Figure 2:
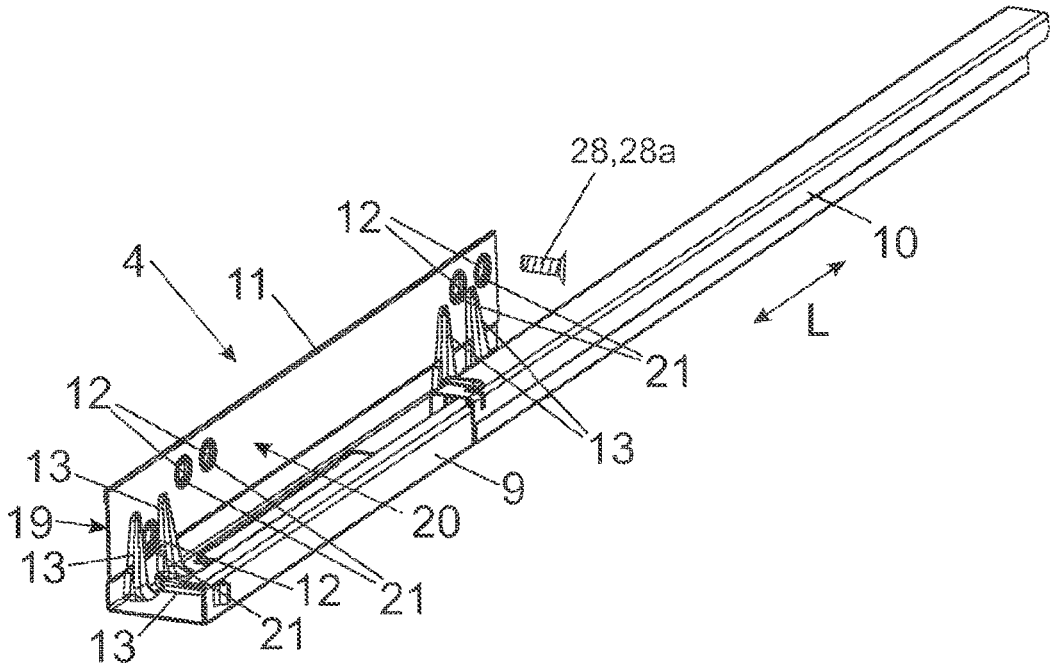
FIG. 2 shows a drawer pull-out guide in a perspective view.

FIG. 2 shows a drawer pull-out guide 4 in a perspective view, wherein the carcass rail 9 to be fastened to the furniture carcass 2 and the drawer rail 10 mobile in the longitudinal direction (L) are shown. The carcass rail 9 is to be fastened to the furniture carcass 2 via a fastening portion 11.

The fastening portion 11 has a fastening side 19, which can be attached to the furniture carcass 2 at least partially during installation of the drawer pull-out guide 4 on the furniture carcass 2.

The fastening portion 11 can have at least one, preferably circular, opening 12 for a fastener 28, in particular a screw 28*a*, to pass through, through which opening the fastening portion 11 is to be fastened to the furniture carcass 2*a*.

On a second side 20 facing away from the fastening side 19, the at least one opening 12 is surrounded by a, preferably annular, ridge 21, which protrudes transversely from the second side 20 of the fastening portion 11.

The screwhead of the screw 28*a* is at least partially countersinkable through this ridge 21. In addition, the peripheral rim of the opening 12 is strengthened by the ridge 21, wherein the risk of damage to the peripheral rim of the opening 12 is reduced.

The fastening portion 11 and/or the carcass rail 9 and/or the drawer rail 10 can in each case have at least one embossing 13 (also called lock beading or reinforcing bead). At least one opening 12 for a screw 28*a* to pass through can be arranged between two embossings 13, as a result of which the section modulus can be increased in this area.

Figure 3A:
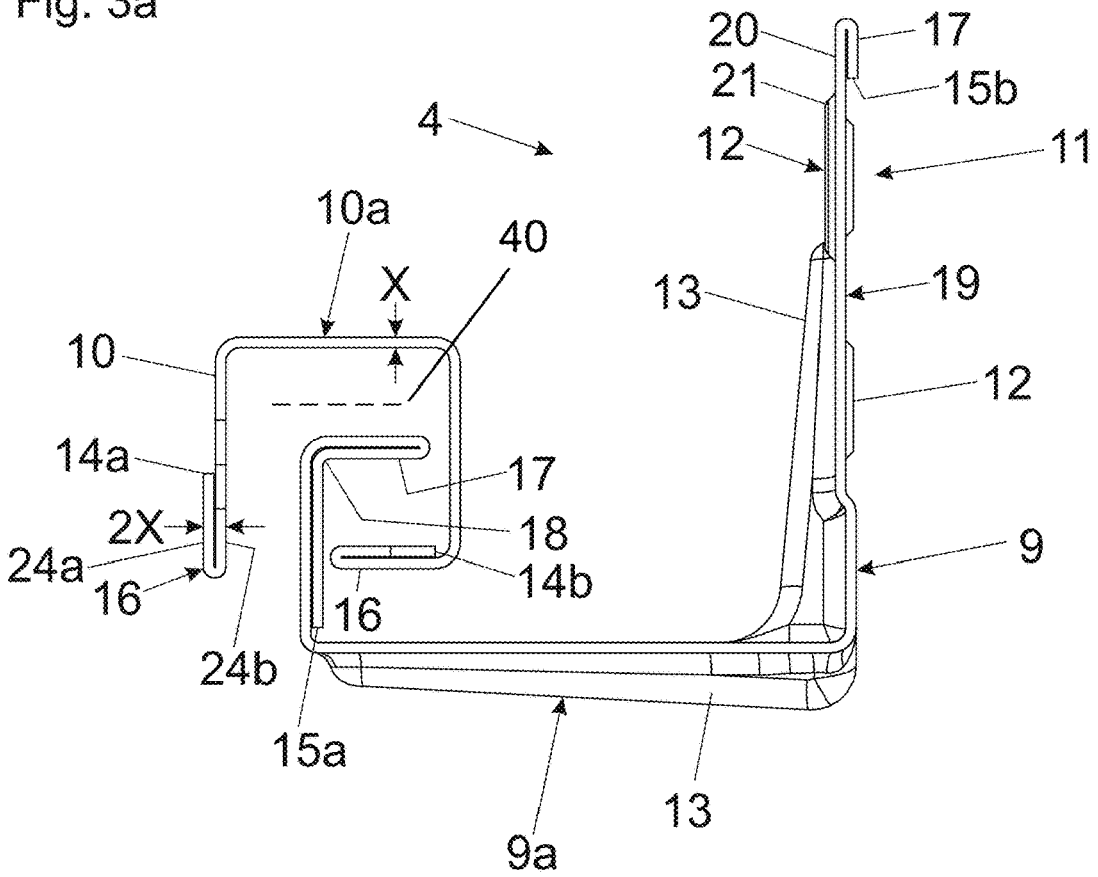
FIGS. 3*a*, 3*b* show a cross section of the drawer pull-out guide without and with carriage.
Figure 3B:
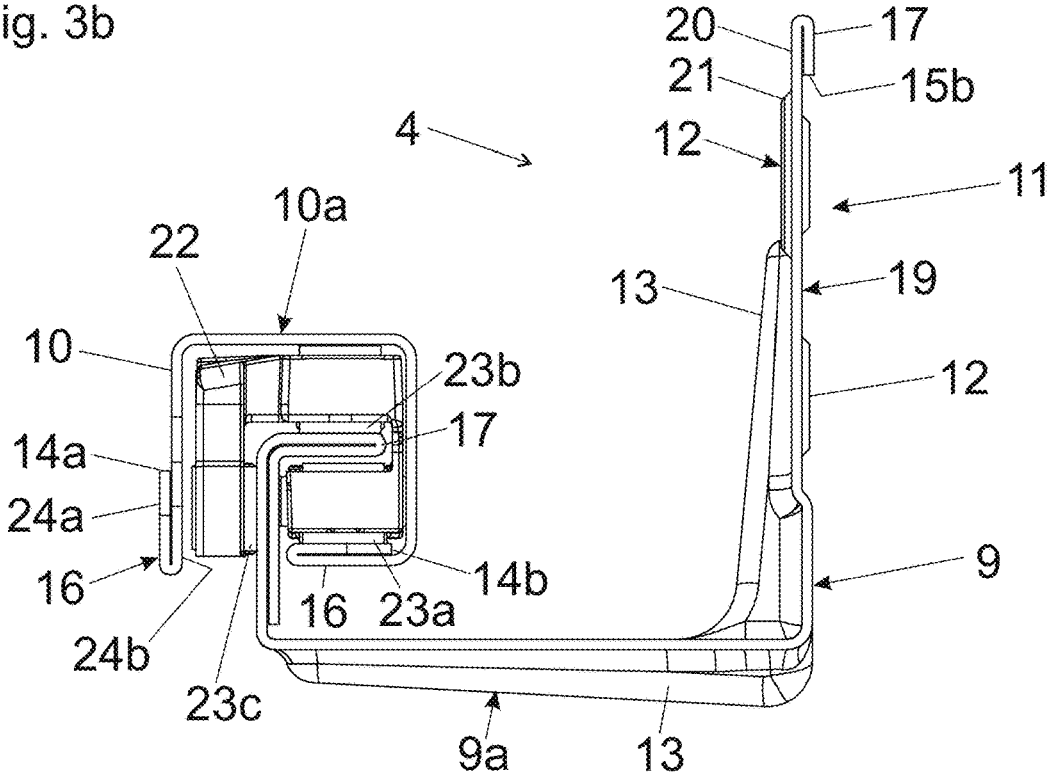

FIGS. 3*a*, 3*b* show a cross section of the drawer pull-out guide 4 without and with carriage 22. FIG. 3*a* shows the drawer pull-out guide 4 in a cross section normal to the longitudinal direction (L), also showing the location of the optional center rail 40. The carcass rail 9, to be fastened to the furniture carcass 2, and the drawer rail 10, mobile relative to the carcass rail 9, are to be recognized.

The fastening portion 11 of the carcass rail 9 has a fastening side 19, which can be attached to the furniture carcass 2 at least in portions during fastening of the carcass rail 9 to the furniture carcass 2.

The carcass rail 9 and/or the drawer rail 10 is or are bent out of a flat metal sheet with two longitudinal edges 14*a*, 14*b* (drawer rail 10) and 15*a*, 15*b* (carcass rail 9) to form a profile 9*a*, 10*a*. The flat metal sheet has a material thickness (X).

The flat metal sheet from which the profile 9*a*, 10*a* is formed can for example have a material thickness (X) of between 0.5 mm and 1.0 mm, preferably a material thickness (X) of 0.7 mm.

The profile 9*a* of the carcass rail 9 and/or the profile 10*a* of the drawer rail 10 has or have at least one foldover 16, 17 with at least a double material thickness (2X) on at least one longitudinal edge 14*a*, 14*b*, 15*a*, 15*b*, preferably on both longitudinal edges 14*a*, 14*b*, 15*a*, 15*b*. The at least one foldover 16, 17 preferably has precisely double the material thickness (2X).

If expedient, however, the foldover 16, 17 can also be folded three or more times, as a result of which there is a triple or multiple material thickness (X).

At least one foldover 16, 17 can be arranged on a longitudinal edge 15*b* of the carcass rail 9, wherein this foldover 16, 17 can be attached during fastening of the carcass rail 9 to the furniture carcass 2.

According to an embodiment, on the at least one longitudinal edge 14*a*, 14*b*, 15*a*, 15*b*, the at least one foldover 16, 17 has at least two metal sheet portions 24*a*, 24*b* at least partially resting against each other-at least in areas.

The at least one drawer rail 10 can have at least one foldover 16, 17 with at least a double material thickness (2X) on both longitudinal edges 14*a*, 14*b*, wherein the two foldovers 16, 17 are aligned transverse, preferably substantially at right angles, to each other and/or wherein one of the two foldovers 16, 17 is turned inwards and the other of the two foldovers 16, 17 is turned outwards.

At least one foldover 16, 17 can have at least one crack 18 running in the longitudinal direction (L) on the at least one longitudinal edge 14*a*, 14*b*, 15*a*, 15*b* in a cross section normal to the longitudinal direction (L), preferably wherein the at least one foldover 16, 17 is formed on at least one longitudinal edge 15*a* of the carcass rail 9.

The at least one fastening portion 11 can have at least one, preferably circular, opening 12 for a fastener 28 (FIG. 2), preferably a screw 28*a*, to pass through.

According to an embodiment, it can be provided that, on a second side 20 spaced apart from the fastening side 19 by a material thickness (X) of the fastening portion 11, the at least one opening 12 is surrounded by a ridge 21 which protrudes transversely from the second side 20.

The stiffness of the fastening portion 11 in the area of the opening 12 can be substantially improved by the ridge 21 which surrounds the opening 12, which is advantageous in particular in the case of use with metal sheets with thin material thickness (X).

At least one embossing 13 can have a longitudinal direction, which extends transverse to the longitudinal direction (L) of the carcass rail 9. At least one embossing 13 or several embossings 13 can be arranged on the vertical leg of the fastening portion 11 and/or on the transverse leg of the fastening portion 11.

FIG. 3*b* shows the drawer pull-out guide 4 according to FIG. 3*a* in a cross section with fitted rolling bodies 23*a*, 23*b*, 23*c*.

Preferably, the rolling bodies 23*a*, 23*b*, 23*c* are mounted in a common carriage 22, wherein the carriage 22 is mounted mobile between the carcass rail 9 and the at least one drawer rail 10.

According to possible embodiments, at least one rolling body 23*a*, in an installation position, has a cylindrical shape, is rotatable about a horizontal axis and is mobile along the foldover 16 of the drawer rail 10.

At least one further rolling body 23*a*, in an installation position, is rotatable about a horizontal axis and is mobile along the foldover 17 of the carcass rail 9.

At least one further rolling body 23*c*, in an installation position, is rotatable about a vertical axis and is mobile along a portion of the carcass rail 9 with a double wall thickness (2X).

The carriage 22 with the rolling bodies 23*a*, 23*b*, 23*c* (which can alternatively or additionally also be formed as sliding bodies) is arranged on the drawer pull-out guide 4, wherein the embossings 13 are arranged on the carcass rail 9 and the drawer rail 10 in such a way that the embossings 13 are traversable contactlessly in the longitudinal direction L by the carriage 22 and the rolling bodies 23*a*, 23*b*, 23*c*.

Figure 4A:
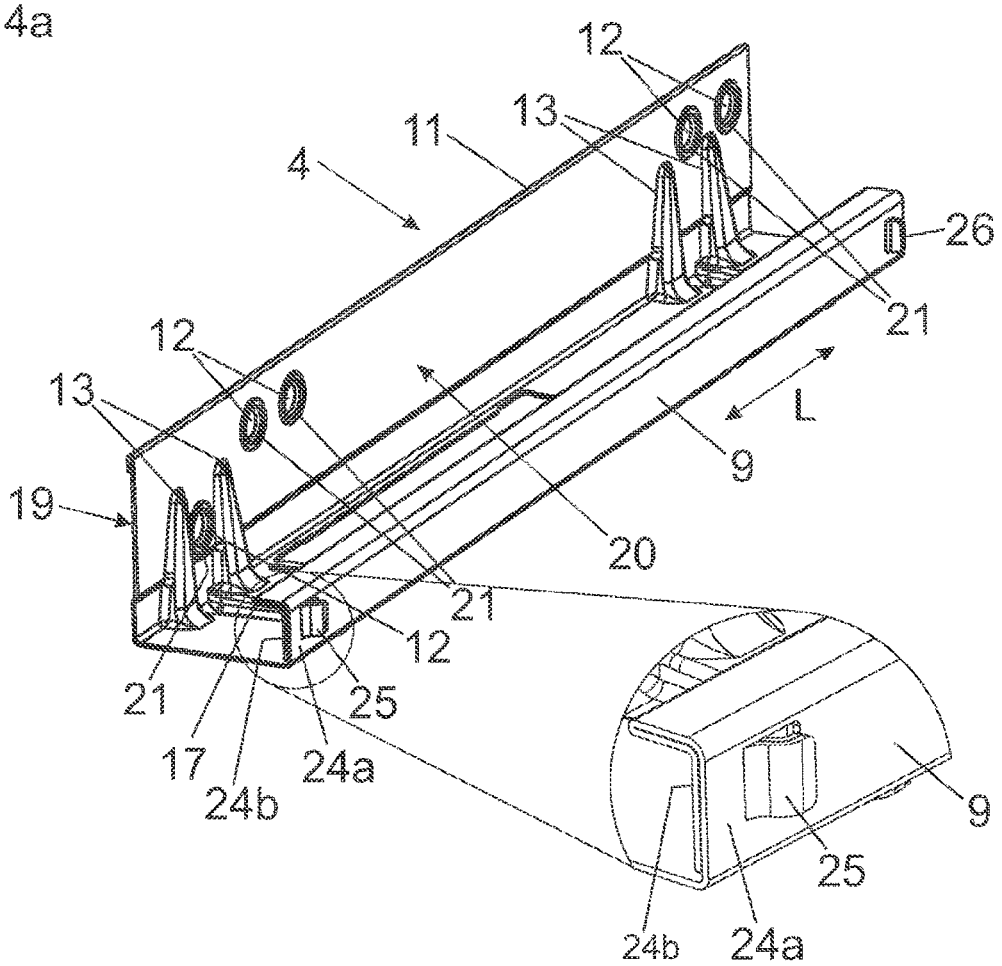
FIGS. 4*a*, 4*b* show the carcass rail of the drawer pull-out guide in a perspective view from a first angle of view and in a cross-sectional view.
Figure 4B:
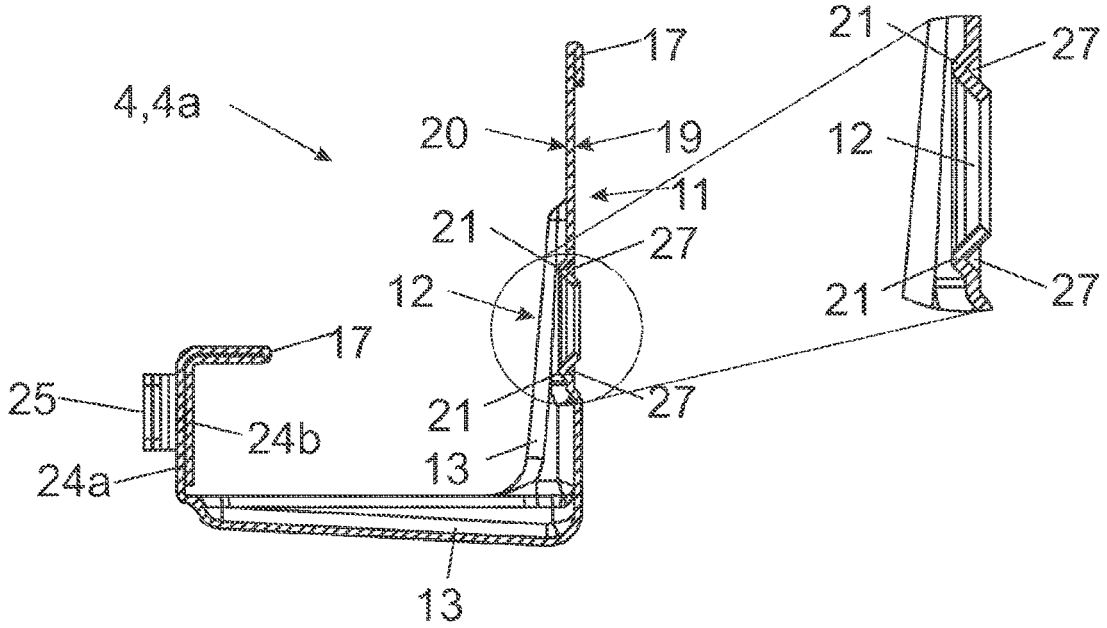

FIGS. 4*a*, 4*b* show the carcass rail 9 of the drawer pull-out guide 4 in a perspective view from a first angle of view and in a cross-sectional view.

FIG. 4*a* shows the profile 9*a* of the carcass rail 9 in a perspective view. The fastening portion 11 for fastening the carcass rail 9 has a first (fastening) side 19 for resting against the furniture carcass 2. At least one opening 12 for a fastener 28, in particular a screw 28*a*, to pass through, through which opening the carcass rail 9 is to be fastened to the furniture carcass 2, is arranged on the fastening portion 11.

On a second side 20 spaced apart from the first (fastening) side 19 by a material thickness (X), the at least one opening 12 is surrounded by a ridge 21, which protrudes transversely from the second side 20 of the fastening portion 11. The screwhead of a screw 28*a* for fastening the fastening portion 11 to the furniture carcass 2, in an installed state, is at least partially received inside the annular ridge 21 at least in areas, preferably substantially completely.

The metal sheet portions 24*a*, 24*b* of the foldover 16, 17 resting against each other are connected to each other by at least one common punching 25, 26. In this way the foldover 16, 17 can be additionally stabilized.

According to an embodiment two punchings 25, 26 spaced apart from each other in the longitudinal direction (L) are provided.

According to preferred embodiments:

- the at least one punching 25, 26 is arranged at one end of the profile 9*a* of the carcass rail 9 and/or of the profile 10*a* of the at least one drawer rail 10, and/or
- at least two common punchings 25, 26 are provided, preferably wherein the at least two punchings 25, 26 are formed mirror-inverted relative to each other, and/or
- at least one carriage 22 (FIG. 3*b*) is provided and the at least one punching 25, 26 forms a limit stop for limiting a route of the at least one carriage 22, and/or
- the at least one punching 25, 26 is formed as an angled tab.

The at least one punching 25, 26 can thus assume a dual function. On the one hand, the punching 25, 26 serves to stabilize the metal sheet portions 24*a*, 24*b* of the foldover 16, 17 resting against each other.

On the other hand, the laterally protruding punching 25, 26 is provided to limit a route of the carriage 22 in the longitudinal direction (L). The carriage 11 obtains a defined end position through the punching 25, 26 and therefore cannot overrun an end of the carcass rail 9 and/or of the at least one drawer rail 10.

FIG. 4*b* shows the drawer pull-out guide 4 according to FIG. 4*a* in a cross section. At least one recess 27 for receiving accumulating chip material in areas is arranged on the first (fastening) side 19 of the fastening portion 11 and neighboring the at least one opening 12. In this way, when the fastening portion 11 is being screwed on, an undesired lifting of the fastening portion 11 from the furniture part 2 can be prevented.

Figure 5A:
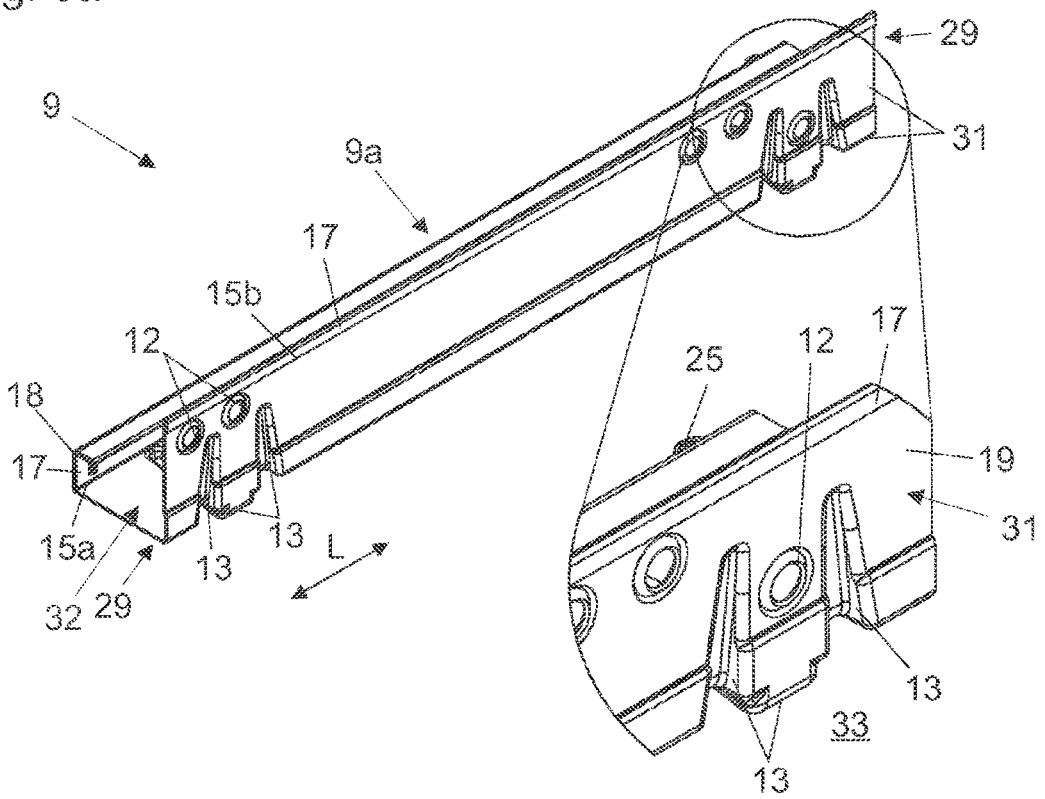
FIGS. 5*a*, 5*b*, 5*c* show the carcass rail of the drawer pull-out guide in a perspective view from a second angle of view, in a side view from the front and in a side view from the back.
Figure 5B:
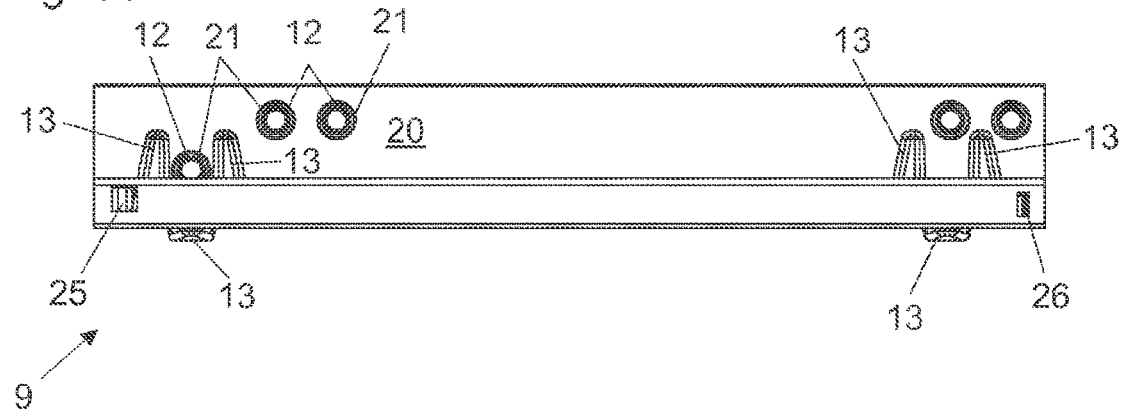
Figure 5C:
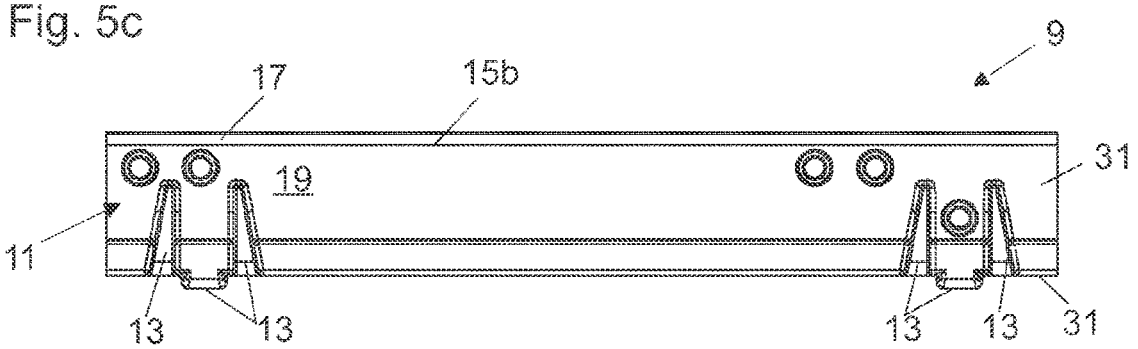

FIGS. 5*a*, 5*b*, 5*c* show the carcass rail 9 of the drawer pull-out guide 4 in a perspective view from a second angle of view, in a side view from the front and in a side view from the back.

FIG. 5*a* shows the carcass rail 9 with two groups of in each case three embossings 13, which are in each case spaced apart from each other in an edge area of the carcass rail 9. In a cross section normal to the longitudinal direction L, the carcass rail 9 has a profile 9*a* formed from a flat metal sheet with two longitudinal edges 15*a*, 15*b* running parallel to each other; For each group, three embossings 13 are arranged on two lateral surfaces 31 oriented orthogonal to and adjoining each other, and the embossings 13 face in the direction of an inner area 32 (an area at least partially enclosed by the rails of the pull-out guide) and in the direction of an outer area 33 of the carcass rail 9 in an alternating manner. The embossings 13 of the groups adjoin each other in the longitudinal direction L.

The embossings 13 have a cross section tapering in the direction toward the longitudinal edges 15*a*, 15*b*, wherein three. Three embossing surfaces are oriented relative to each other in the manner of a truncated pyramid, as larger stresses generally occur in the area of a transition of the lateral surfaces 31 than in the area of the longitudinal edges 15*a*, 15*b*.

The embossings 13 have a cross section tapering in the direction toward the longitudinal edges 15*a*, 15*b*, wherein three embossing surfaces are oriented relative to each other in the manner of a truncated pyramid, as larger stresses generally occur in the area of a transition of the lateral surfaces 31 than in the area of the longitudinal edges 15*a*, 15*b*.

FIG. 5*b* and FIG. 5*c* differ from FIG. 5*a* only through an altered angle of view, wherein the carcass rail 9 is visible from a rear side and from a front side. For each group precisely three embossings 13 for reinforcing the profile 9*a* are arranged in areas on two orthogonally arranged lateral surfaces 31 of the carcass rail 9.

For each group two embossings 13 are arranged on the same lateral surface 31 and end in a transition area of the adjoining lateral surface 31. The embossings are arranged on the two adjoining lateral surfaces 31 in an alternating manner, wherein the three embossings 13 of the respective group are arranged in a transition area of the two lateral surfaces 31 in an alternating manner relative to the inner area 32 and the outer area 33. The three embossings 13 of the groups face into the inner area 32 and into the outer area 33 in an alternating manner, wherein two embossings 13 face in the direction of the inner area 32 of the carcass rail 10 and one embossing 13 is arranged in the middle between the two embossings 13 and faces in the direction of the outer area 33 of the carcass rail 9 to increase a tensile/compressive strength.

It is recognizable in FIG. 5*c* that embossings 13 extend across a step in the profile 9*a* of the carcass rail 9.

Figure 6A:
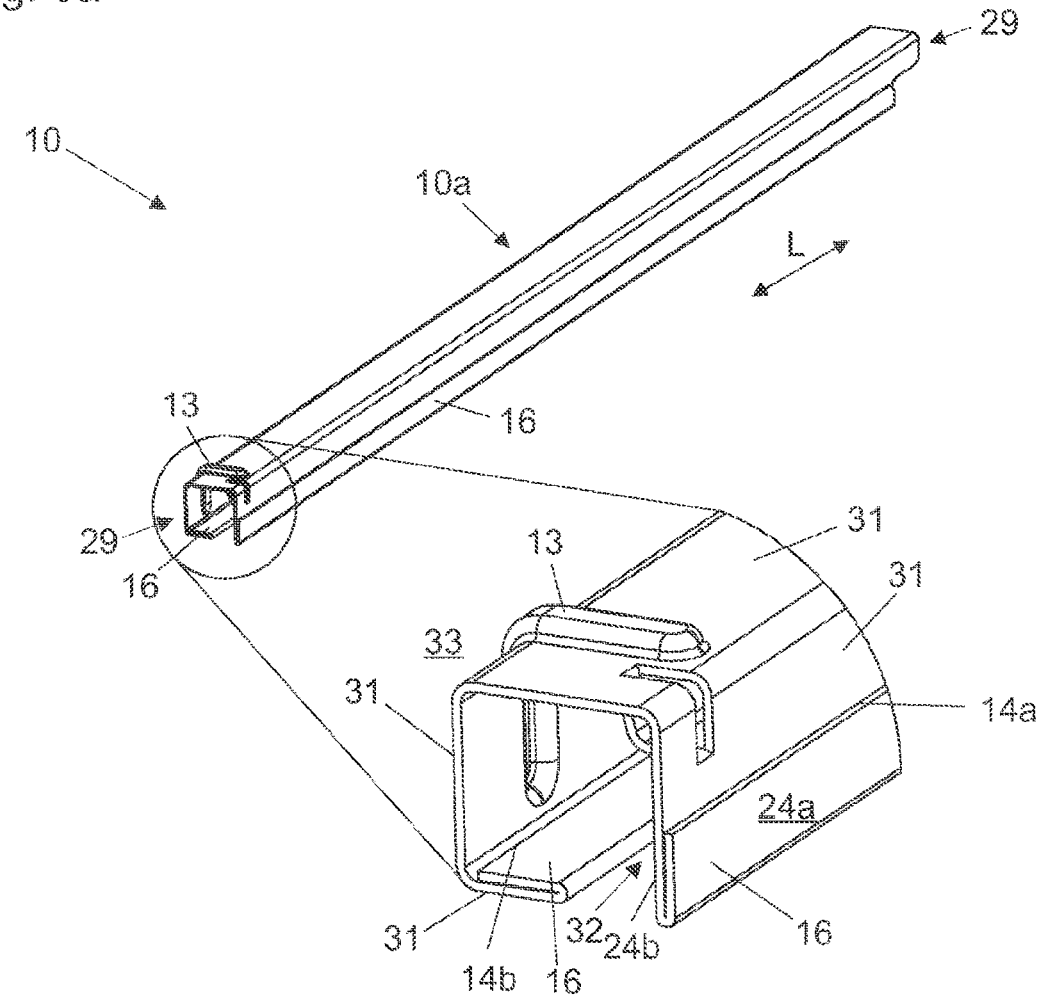
FIGS. 6*a*, 6*b* show the drawer rail of the drawer pull-out guide in a perspective view and in a side view from the front.
Figure 6B:
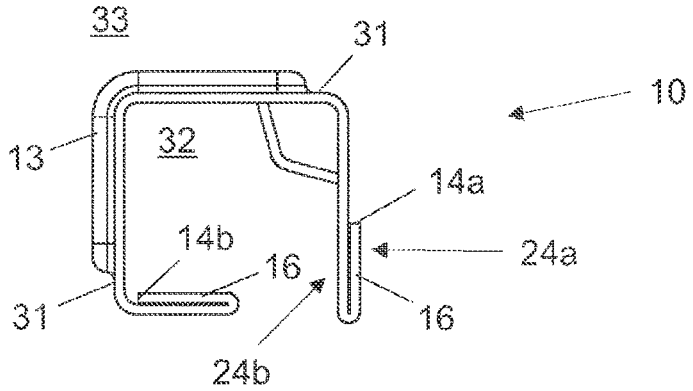

FIGS. 6*a*, 6*b* show the drawer rail 10 of the drawer pull-out guide 4 in a perspective view and in a side view from the front.

FIG. 6*a* shows a drawer rail 10 which has, in a cross section normal to the longitudinal direction L, a profile 10*a* formed from a flat metal sheet with two longitudinal edges 14*a*, 14*b* running parallel to each other. An embossing 13 extending over two lateral surfaces 31 of the profile 10*a* arranged orthogonal to each other is arranged for reinforcing the profile 10*a*. The lateral surfaces 31 are arranged in the longitudinal direction L and the embossing 13 is arranged orthogonal to the longitudinal direction L. The embossing 13 of the drawer rail has three embossing surfaces arranged orthogonal to each other.

FIG. 6*b* shows the drawer rail 10 in a view from the side, wherein the embossing 13 extends in the orthogonal direction relative to the longitudinal direction L of the drawer rail 10 over two adjoining lateral surfaces 31 and a punching is provided on the drawer rail 10, which protrudes into the inner area 32 and serves as a limit stop for the carriage 22. The punching is connected in a material-bonding manner to two adjoining lateral surfaces 31 of the drawer rail 10. One of these lateral surfaces 31 has the embossing 13, and the other lateral surface 31 has a foldover 16. The embossing 13 extends over two lateral surfaces 31 just before a transition area of the associated lateral surfaces 31. The embossing 13 faces in the direction of the outer area 33.

Figure 7A:
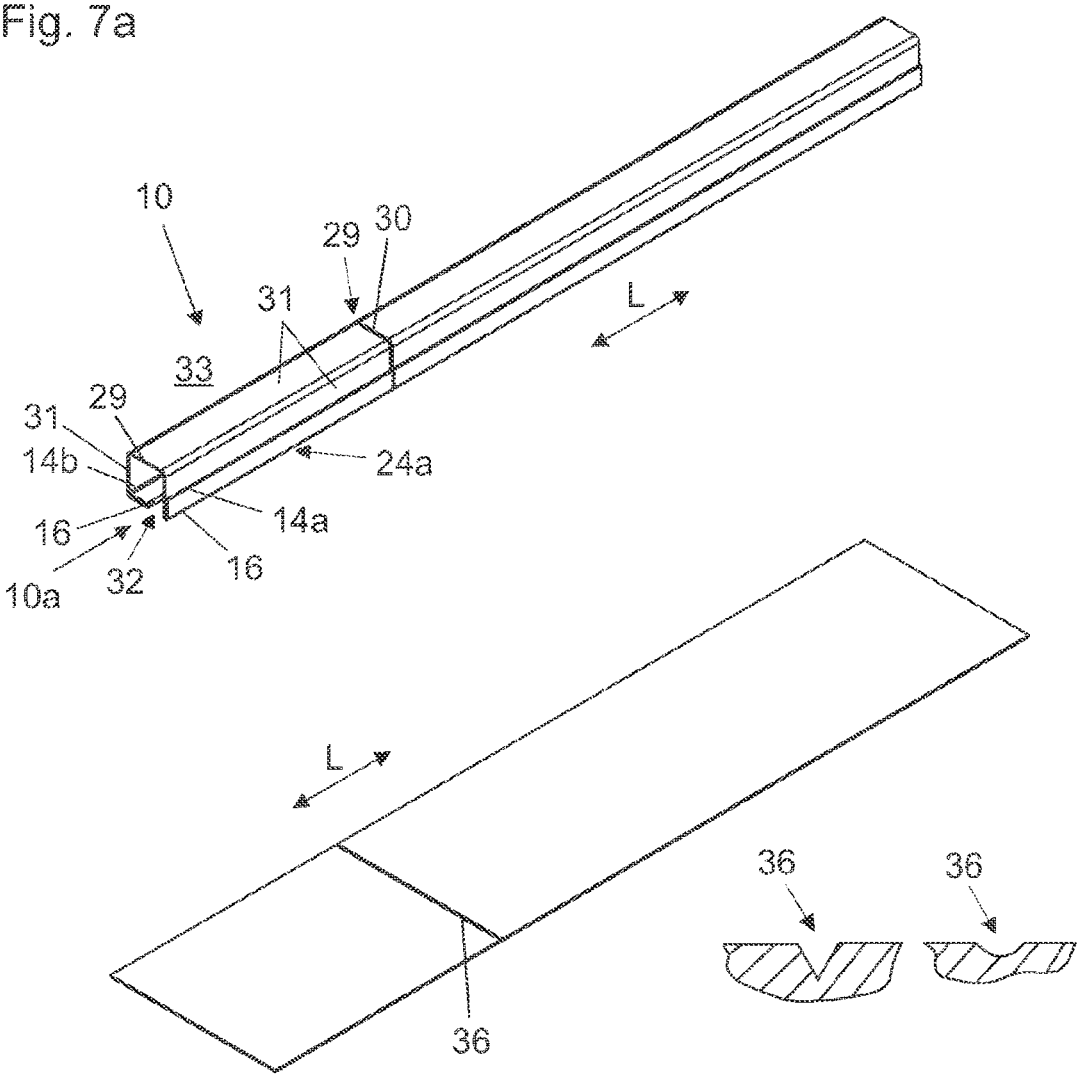
FIGS. 7*a*, 7*b*, 7*c* show a method for producing a profile of a rail of the drawer pull-out guide.
Figure 7B:
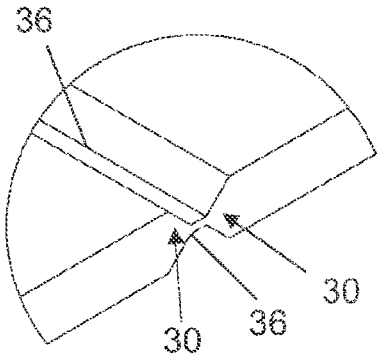
Figure 7C:
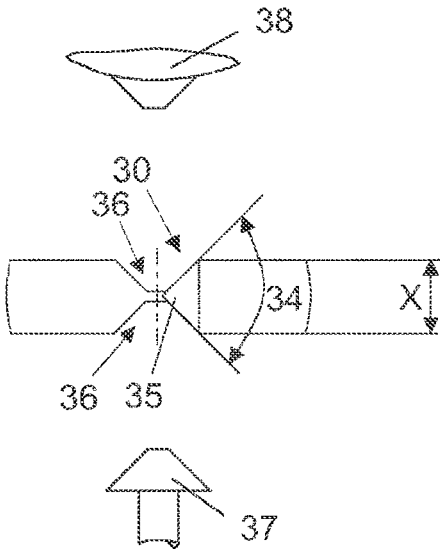

FIGS. 7*a*, 7*b*, 7*c* show a method for producing a profile 9*a*, 10*a* of a rail of the drawer pull-out guide 4.

FIG. 7*a* shows a drawer rail 10 of the drawer pull-out guide 4, wherein the drawer rail 10 has, in a cross section normal to the longitudinal direction L, a profile 10*a* formed from a flat metal sheet. One of the two end surfaces 29 of the profile 10*a* has a taper 30 caused by mechanical breaking of a semifinished product, wherein both end surfaces 29 can generally have a taper 30.

To form the taper 30 two indentations 36 have been introduced into the flat metal sheet, which extend over a width of the metal sheet oriented orthogonal to the longitudinal direction L and are arranged on both top surfaces of the metal sheet. The cross section of the indentation 36 is generally as desired and can represent for example a triangle shape or an elliptical portion as in the schematic detail sections of a cross section of a metal sheet. The geometry and depths of a plurality of indentations 36 can generally also vary, wherein four indentations 36 are particularly preferably utilized in order to form a drawer rail 10, a carcass rail 9 or a center rail with in each case one taper 30 per end surface 30 using non-cutting mechanical separation.

A metal sheet with two indentations 36 with a trapezoidal cross section, which results in two tapers 30—in each case one taper per drawer rail 10—after a cutting-to-length process of the drawer rail 10, can be seen in FIG. 7*b*. However, only one indentation 36 on a top surface of the metal sheet can generally also be utilized. The indentations 36 are advantageously introduced before a bending procedure, wherein this is not compulsory.

FIG. 7*c* illustrates an embossing procedure for introducing the indentations 36 via an embossing die 37 and an embossing roller 38, wherein two embossing rollers or two embossing dies 37 are particularly preferably provided. The material thickness X of the metal sheet is made smaller locally, with the result that the taper manifests on the rail to be formed with an angle 34 of 90° with a burr-free end surface 29.

A taper cross section 35 parallel to the longitudinal extent of the metal sheet has the shape of an isosceles triangle, wherein other geometries are possible in the taper cross section 35 depending on the indentations 36—for example a right-angled triangle in the case of an indentation 36 on one side. The taper 30 can have a taper ridge due to manufacturing and can be designed concave or convex.

The invention claimed is:

1. A drawer pull-out guide for movably mounting a drawer on a furniture carcass, comprising:

a carcass rail to be fastened to the furniture carcass, and a drawer rail to be connected to the drawer, the drawer rail being mounted displaceable relative to the carcass rail in a longitudinal direction wherein the drawer pull-out guide has a dead weight and a maximum load-bearing capacity, wherein a ratio of the dead weight of the drawer pull-out guide to the maximum load-bearing capacity of the drawer pull-out guide is less than 1 to 50, and wherein the drawer pull-out guide has at least one property selected from the following group of properties i to v:

i) at least one of the carcass rail and the drawer rail has, in a cross section normal to the longitudinal direction, a profile formed from a flat metal sheet having two longitudinal edges extending parallel to each other, the profile having at least two foldovers each with at least a double material thickness, each of the two longitudinal edges having at least one of the at least two foldovers thereon, ii) the carcass rail has a fastening portion with a fastening first side to be at least partially attached to the furniture carcass during installation of the drawer pull-out guide on the furniture carcass, the fastening portion having an opening for allowing a fastener to pass therethrough, the opening being surrounded by a ridge on a second side of the fastening portion spaced apart from the first side by a material thickness of the fastening portion and projecting inwardly, the ridge protruding from the second side in a direction transverse to the longitudinal direction, iii) at least one of the carcass rail and the drawer rail has, in a cross section normal to the longitudinal direction, the profile formed from the flat metal sheet, a front end surface of the profile having a taper thereon, iv) at least one of the carcass rail and the drawer rail has, in a cross section normal to the longitudinal direction, the profile formed from a the flat metal sheet with two longitudinal edges extending parallel to each other, an embossing extending at least partially over at least two lateral outer surfaces of the profile so as to face outwardly with respect to the profile to thereby reinforce the profile, the at least two lateral outer surfaces arranged substantially orthogonal to each other and extending in the longitudinal direction, and the embossing being substantially orthogonal to the longitudinal direction, and v) at least one of the carcass rail and the drawer rail has, in a cross section normal to the longitudinal direction, the profile formed from a the flat metal sheet with the two longitudinal edges extending parallel to each other, the profile having at least two opposed embossings including a first embossing on a first side surface of the profile facing toward an inner area of the profile, and a second embossing on a second side surface of the profile facing toward an outer area of the profile.

2. The drawer pull-out guide according to claim 1, wherein the drawer rail is displaceable relative to the carcass rail over a pull-out length between a pushed-in end position and a pulled-out end position, the drawer rail having a front end to be connected to a front panel of the drawer, and the drawer rail being configured to, in the pulled-out end position, the front end of the drawer rail drop by a maximum of 4% of the pull-out length if carrying a load corresponding to the maximum load-bearing capacity.

3. The drawer pull-out guide according to claim 1, wherein the drawer pull-out guide:

has a length of between 200 mm and 650 mm in a completely pushed-in state, and/or has a dead weight of between 125 g and 550 g, and/or has a maximum load-bearing capacity of between 15 kg and 35 kg, and/or is manufactured at least predominantly from steel.

4. The drawer pull-out guide according to claim 1, further comprising a rolling body arranged between the carcass rail and the drawer rail.

5. The drawer pull-out guide according to claim 4, wherein:

the rolling body is mounted rotatable about an axis of rotation, and the axis of rotation is aligned transverse to the longitudinal direction, and/or the drawer pull-out guide further comprises a carriage including the rolling body arranged therein, and/or the rolling body is substantially cylindrical, and/or the rolling body is at least predominantly plastic.

6. The drawer pull-out guide according to claim 1, wherein the drawer pull-out guide is at least partially formed from a flat metal sheet having a material thickness of between 0.5 mm and 1.0 mm.

7. The drawer pull-out guide according to claim 1, wherein the drawer pull-out guide has property i, and the foldover:

is arranged on a longitudinal edge of the carcass rail to be attached to the furniture carcass during fastening of the carcass rail, and/or has at least two metal sheet portions resting against each other on the longitudinal edge, and/or has a crack extending in the longitudinal direction on the longitudinal edge in a cross section normal to the longitudinal direction.

8. The drawer pull-out guide according to claim 7, wherein the at least two metal sheet portions have a common punching, and the foldover is formed on a longitudinal edge of the carcass rail.

9. The drawer pull-out guide according to claim 1, wherein the drawer pull-out guide has property i, and the drawer pull-out guide has a rolling body movable at least partially in the longitudinal direction along the foldover.

10. The drawer pull-out guide according to claim 1, wherein the drawer pull-out guide has property i, and the at least two foldovers on the two longitudinal edges are aligned transverse to each other and/or a first one of the at least two foldovers is turned inwards and a second one of the at least two foldovers is turned outwards.

11. The drawer pull-out guide according to claim 10, wherein the foldovers on the two longitudinal edges are aligned substantially at right angles to each other.

12. The drawer pull-out guide according to claim 1, wherein the drawer pull-out guide has property ii, and wherein the ridge:

has a substantially toroidal cross section, and/or is formed in one piece together with the fastening portion, and/or is an embossing in the fastening portion.

13. The drawer pull-out guide according to claim 1, wherein the drawer pull-out guide has property iii, and wherein the taper:

has an angle in a range between 60° and 140°, and/or has a taper cross section parallel to a longitudinal axis of the metal sheet, and substantially shaped as a triangle.

14. The drawer pull-out guide according to claim 13, wherein the taper:

has an angle in a range between 75° and 105°, and both end surfaces are substantially burr-free, and/or the taper cross section is shaped as an isosceles triangle, and the taper cross section is convex and/or concave.

15. The drawer pull-out guide according to claim 1, wherein the drawer pull-out guide has property iv and/or v, and the drawer pull-out guide further comprising a carriage including a rolling body and/or a sliding body on the carcass rail and the drawer rail, the embossing being arranged on the carcass rail and/or the drawer rail such that the embossing is traversable contactlessly in the longitudinal direction by the carriage and/or the rolling body, and/or sliding body.

16. The drawer pull-out guide according to claim 1, wherein the drawer pull-out guide has property iv and/or v, and the embossing is one of precisely three embossings for reinforcing the profile, the three embossings being arranged at least partially on at least two substantially orthogonally arranged lateral surfaces of the at least one of the carcass rail and the drawer rail.

17. The drawer pull-out guide according to claim 1, wherein the drawer pull-out guide has property v, and the at least two opposed embossings extend over at least two lateral surfaces in an alternating manner.

18. The drawer pull-out guide according to claim 17, wherein at the at least two opposed embossings are arranged in a transition area of the at least two lateral surfaces in an alternating manner relative to the inner area and the outer area.

19. The drawer pull-out guide according to claim 1, wherein the drawer pull-out guide has property iv and/or v, and wherein the profile includes at least three embossings in total, the at least three embossings including two embossings facing toward an inner area of the at least one of the carcass rail and the drawer rail and one embossing between the two embossings and facing toward an outer area of the at least one of the carcass rail and the drawer rail to increase a tensile/compressive strength.

20. The drawer pull-out guide according to claim 1, wherein the drawer pull-out guide has property iv and/or v, and at least one embossing extends in an orthogonal direction relative to the longitudinal direction over an area of between one third and three quarters of at least one of the at least two lateral surfaces, and/or extends over an area of less than one third of an adjoining lateral surface adjoining the at least one of the at least two lateral surfaces.

21. The drawer pull-out guide according to claim 20, wherein the at least one embossing extends over an area of less than one quarter of the adjoining lateral surface adjoining the at least one of the at least two lateral surfaces.

22. The drawer pull-out guide according to claim 1, further comprising a center rail between the carcass rail and the drawer rail, and the ratio of the dead weight of the drawer pull-out guide to the maximum load-bearing capacity of the drawer pull-out guide is less than 1 to 65.

23. The drawer pull-out guide according to claim 1, wherein the opening of the fastening portion is circular.

24. The drawer pull-out guide according to claim 1, wherein both the front end surface and a rear end surface of the profile have a taper.

25. The drawer pull-out guide according to claim 1, wherein the first side surface and the second side surface on which the at least two opposed embossings are arranged are oriented substantially orthogonal to and/or adjoining each other, and the at least two opposed embossings adjoin each other in the longitudinal direction.

* * * * *